US007488276B2

(12) United States Patent
Luigi

(10) Patent No.: US 7,488,276 B2
(45) Date of Patent: Feb. 10, 2009

(54) SPARRING PARTNER

(76) Inventor: Giancarlo Luigi, Avenida Pedro Albizu Campos #62, Suite 2, Aguadilla, PR (US) 00603

( * ) Notice: Subject to any disclaimer, the term of this patent is extended or adjusted under 35 U.S.C. 154(b) by 0 days.

(21) Appl. No.: 11/603,074

(22) Filed: Nov. 22, 2006

(65) Prior Publication Data

US 2008/0119335 A1 May 22, 2008

(51) Int. Cl.

| | |
|---|---|
| ***A63B 69/34*** | (2006.01) |
| ***A63B 69/32*** | (2006.01) |
| ***A63B 69/20*** | (2006.01) |
| ***A63B 69/28*** | (2006.01) |
| ***A63B 69/30*** | (2006.01) |

(52) U.S. Cl. ..... 482/89; 482/83; 482/86

(58) Field of Classification Search ..... 482/83, 482/89, 84, 86, 87

See application file for complete search history.

(56) References Cited

U.S. PATENT DOCUMENTS

| | | | | |
|---|---|---|---|---|
| 1,685,495 | A * | 9/1928 | Latz | 482/89 |
| 3,421,759 | A * | 1/1969 | Chambers | 482/89 |
| 4,434,980 | A * | 3/1984 | Babineaux | 482/86 |
| 4,593,900 | A * | 6/1986 | Burke | 482/83 |
| 4,721,302 | A * | 1/1988 | Murphy | 482/89 |
| 5,352,170 | A * | 10/1994 | Condo et al. | 482/83 |
| 5,716,302 | A * | 2/1998 | Andersson | 482/84 |
| 6,348,028 | B1 * | 2/2002 | Cragg | 482/148 |
| 6,416,445 | B1 * | 7/2002 | Nelson et al. | 482/83 |
| 7,150,700 | B2 * | 12/2006 | MacKay et al. | 482/83 |
| 2002/0193211 | A1 * | 12/2002 | Kao | 482/83 |
| 2004/0176222 | A1 * | 9/2004 | Mitchell | 482/83 |
| 2006/0025284 | A1 * | 2/2006 | Livingstone et al. | 482/83 |

* cited by examiner

*Primary Examiner*—Loan H Thanh
*Assistant Examiner*—Sandhara M Ganesan

(57) ABSTRACT

A boxing device that fights back in response to an attackers blows to simulate a boxing match comprises a boxing bag, a pair of padded arms each having a boxing glove at its end, and a pair of reel type pieces wherein each of said reel type piece works as an axis holding each a padded arm that rotates around the piece in response to an impact applied to the boxing bag.

4 Claims, 3 Drawing Sheets

SPARRING PARTNER

STATEMENT REGARDING FEDERALLY SPONSORED RESEARCH AND DEVELOPMENT

N/A

RELATED APPLICATIONS

N/A

BACKGROUND OF THE INVENTION

1. Field of the Invention

This invention relates generally to boxing devices and more particularly to a device that fights back and serves as a sparring partner by swinging its own arms to its attackers.

2. Discussion of the Background

Boxing is not only a sport, but an aerobic exercise too. There are various devices in the prior art that teach or train a person in certain specific aspects of boxing. Some devices in the prior art disclose arm-like structures which may swing at an attacker in response to a blow. For instance U.S. Pat. No. 4,434,980 to Babineaux discloses a device that fights back comprising a boxing bag and a pair of arms. However, Babineaux invention does not simulate actual fighting conditions as the arms swing forward in predictable motions.

Therefore, it can be appreciated that there exists a continuing need for a new and improved training device in the prior art that can train all aspects of boxing and kickboxing in one training session. In this regard, the present invention substantially fulfills this need.

SUMMARY OF THE INVENTION

The object of the present invention is to provide a device that trains the offensive and defensive movements of boxing and kickboxing.

Another object of the present invention is to provide a device that improves the user's offensive and defensive reflexes.

It is still a further object of the present invention to provide a device that gives the user a cardiovascular exercise.

Another object of the present invention is to provide a device that improves muscular strength of the upper and lower body.

A further object of this invention is that it is easy and safe to use.

Still a further object of this invention is that it can be used by both left and right handed boxesrs.

Another object of this invention is to give the user the sensation of being in a boxing match without the risk of injury.

The sparring partner itself, both as to its construction and its mode of operation will be best understood, and additional objects and advantages thereof will become apparent, by the following detailed description of a preferred embodiment taken in conjunction with the accompanying drawings.

When the word "invention" is used in this specification, the word "invention" includes "inventions", that is, the plural of "invention". By stating "invention", the Applicant does not in any way admit that the present application does not include more than one patentably and non-obviously distinct invention and Applicant maintains that the present application may include more than one patentably and non-obviously distinct invention. The Applicant hereby asserts, that the disclosure of the present application may include more than one invention, and, in the event that there is more than one invention, that these inventions may be patentable and non-obvious one with respect to the other.

Further, the purpose of the accompanying abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DESCRIPTION OF THE PREFERRED EMBODIMENT

Figure 1:
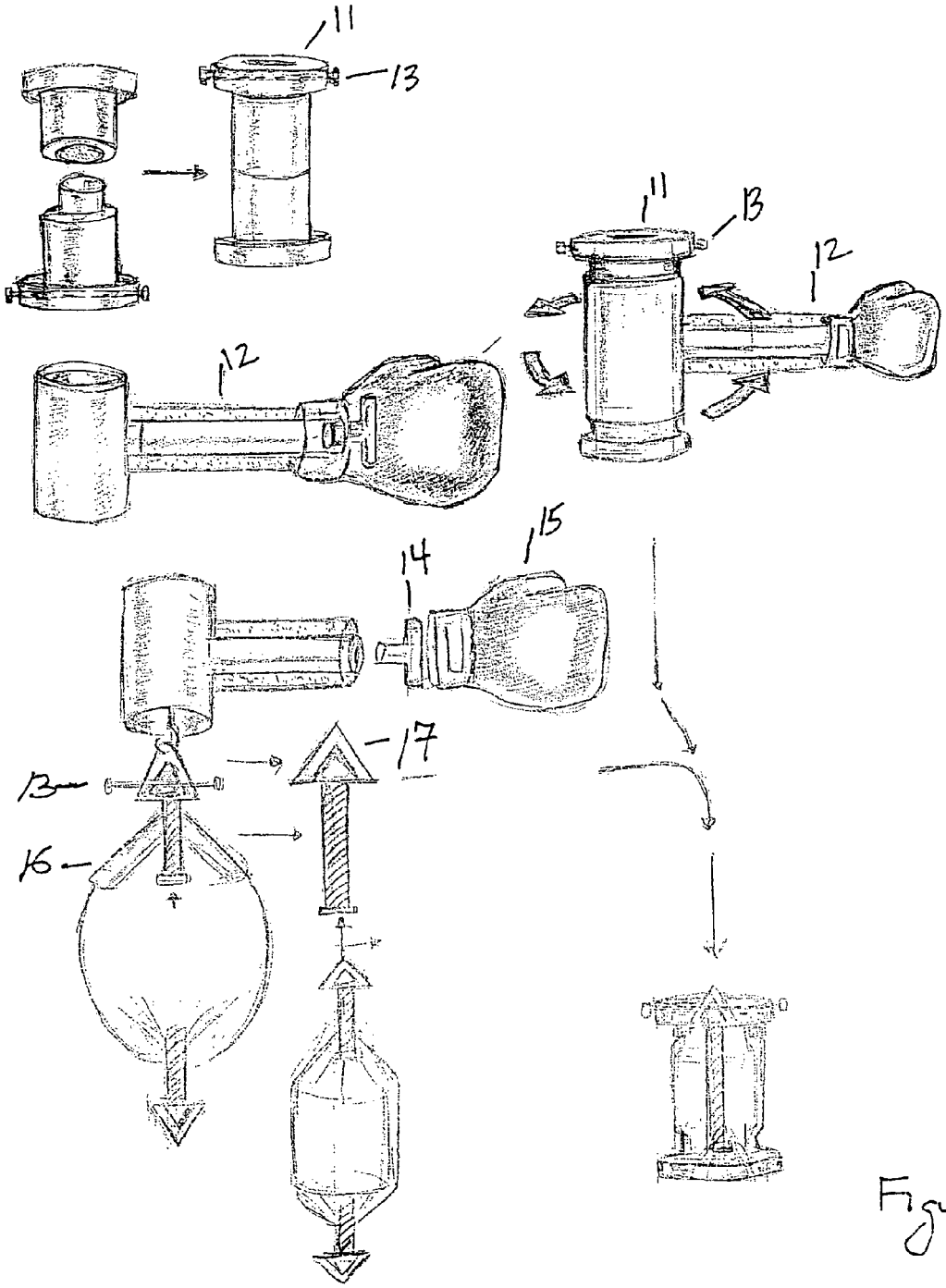
FIG. 1 is a view of the various components of the invention.
Figure 2:
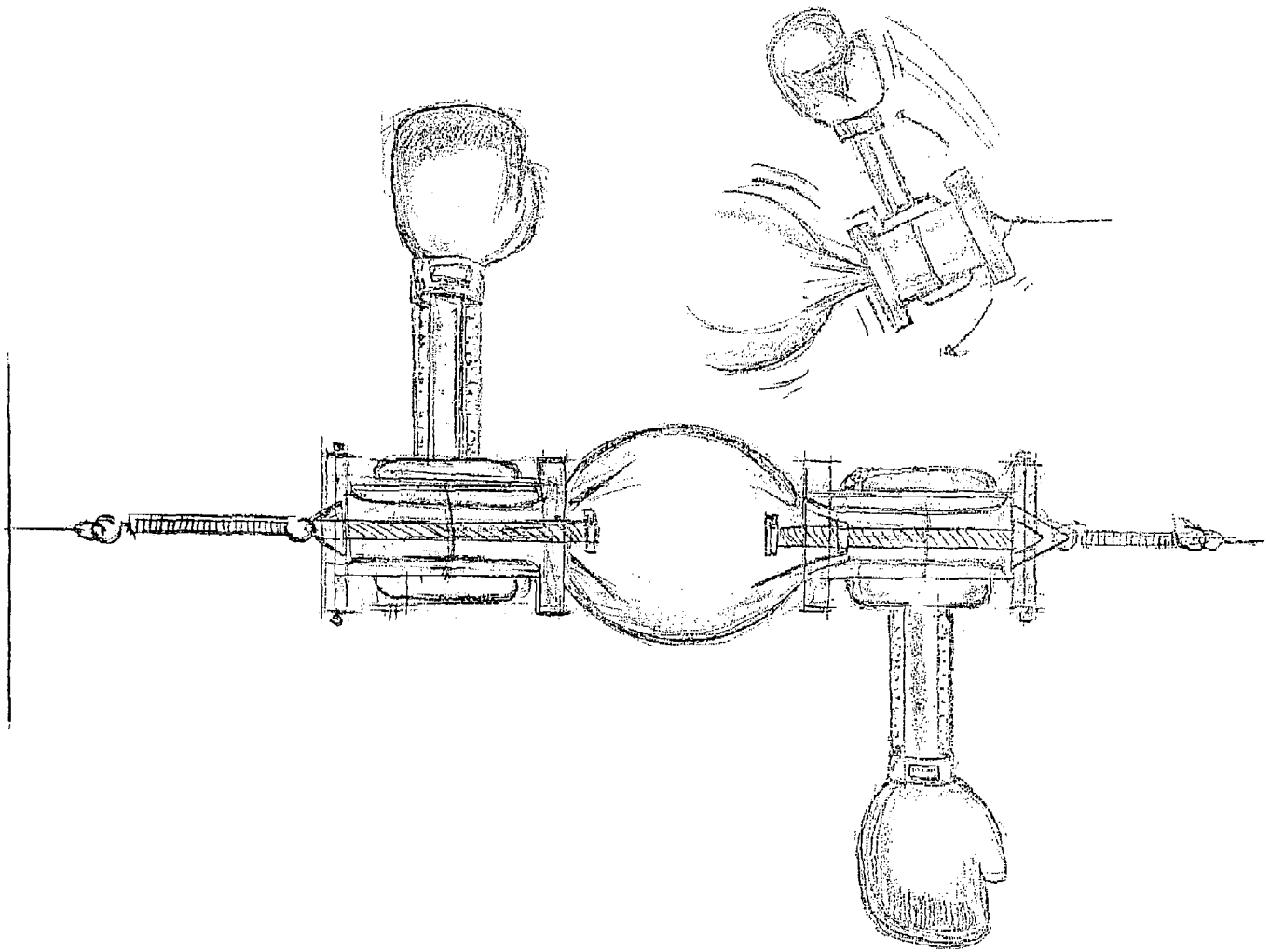
FIG. 2 is a view of an embodiment of the invention using a heavy bag.
Figure 3:
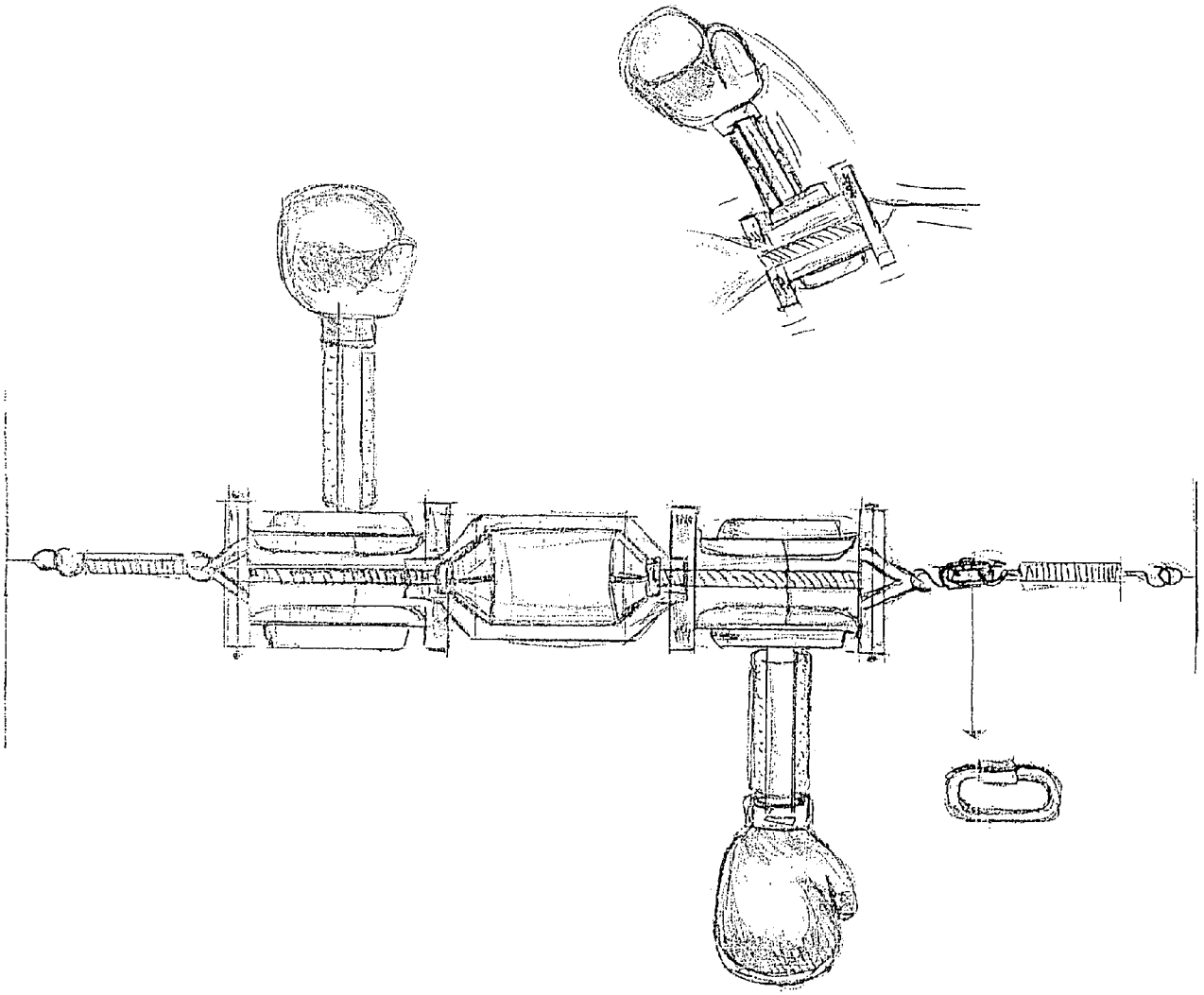
FIG. 3 is a view of an embodiment of the invention using a small heavy bag.

There are two embodiments of the boxing device of the invention: a double end bag (FIG. 2); b. a small heavy bag (FIG. 3). In the preferred embodiment, referring now to the drawings, wherein like reference numerals designate the corresponding structure, part, or element, as the case may be, throughout the views, a boxing device constructed in accordance with the preferred embodiment of the present invention comprises a reel type piece (11) that can be separated from each other and that works as an axis holding the swinging boxing arm (12). This piece holds a metal rod (13) on top of it which holds the nylon or metal cable; a foam covered thick pvc material swinging or rotating boxing arm that moves over the reel type piece with a T-type rod (14) that holds a boxing glove (15); a funnel type piece (16) made of thick aluminum metal or pvc material that is placed over the double end bag bladder and the heavy bag in both superior and inferior portions; both funnels are covered with leather and held in place with tied on strings; the funnel's small portion is inserted into the hollow inferior portion of the reel and a plastic covered or nylon cable runs through it and the reel. This cable is held in place by the metal rod on top of the reel piece. The end of this cable has a metal double triangle (17) to hold the metal rod and the superior rubber cable or metal spring. A similar piece is used to hold the inferior reels rod and rubber cable; the funnel small portion is applied to the hollow inferior portion of the reel and a plastic covered or nylon cable runs through it and the reel. This cable is held in place by the metal rod on top of the reel piece. The end of this cable has a metal double triangle to hold the metal rod and the superior rubber cable or metal spring. A similar piece is used to hold the inferior reels rod and rubber cable; the union of the funnel piece and the hollow reels portion provides a rocking movement that lets the boxing arm move in superior-inferior inferior-superior motion; three of the four plastic covered cables attached to a central ring under the funnel and this one attached to another plastic covered metal cable holds the heavy bag to the upper metal spring in the ceiling. This spring gives flexible movement to the heavy bag. The boxing arms moves unpredictably without a specific pattern.

In other embodiments, pressure sensors can be applied to the boxing arms gloves and to the specific areas of the double end bag and heavy small bag to count the punches that the trainee receives and the punches that he lands to give a simulation of a boxing match. The height of the double end bag and small heavy bag can be adjusted to any trainee by using longer or shorter rubber cables and by changing the amount of chain links and rubber cable respectively. Collored dots can be applied to different areas of the double end bag and small heavy bag to improve punch accuracy.

In the preferred embodiment, the double end bag gives punch speed and the small heavy bag gives punch power. When the double end bag and heavy bag are hit by a punch or foot this initiates an antero-posterior or lateral movement. This movement causes a physical reaction in the boxing arm making a left-right-left horizontal rotational movement. The rocking funnel-reel movement allows a superior-inferior and inferior-superior rotational or straight movement of the boxing arm.

When the user punches the double end bag-small heavy bag hard the boxing arms will hit him back faster and if he hits it softer the boxing arms will move slower.

The upper boxing arm is two inches longer than the inferior boxing arm. This is to simulate a superior jab punch and inferior lower body punch respectively.

Thus, there has been shown and described a boxing device that fights back which fulfills all the objects and advantages sought therefor. The invention is not limited to the precise configuration described above. While the invention has been described as having a preferred design, it is understood that many changes, modifications, variations and other uses and applications of the subject invention will, however, become apparent to those skilled in the art without materially departing from the novel teachings and advantages of this invention after considering this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means-plus-function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patentably distinguish any amended claims from any applied prior art.

What is claimed is:

1. A boxing device that fights backs, comprising:

a substantially fixed supporting structure comprising a pair of rings one upper ring rigidly connected to the ceiling and a lower ring rigidly connected to the floor;

a boxing bag;

a pair of nylon cables each ending in a metal triangle;

a pair of metal springs, an upper and a lower metal spring; wherein the upper metal spring is attached to the upper ring while the lower metal spring is attached to the lower ring;

a pair of padded arms, an upper arm closer to the upper ring and a lower arm closer to the lower ring, each having a T-type rod disposed so as to hold a boxing glove at the lower end of the arm;

a pair of reel type pieces wherein each of said reel type piece works as an axis holding each a padded arm that rotates around the piece in response to an impact applied to the boxing bag; wherein each reel type piece comprises a metal rod at its top end to hold the respective nylon cable;

a pair of funnel shaped pieces covered with leather; wherein each of said pieces is placed over the top and bottom ends respectively of the boxing bag and secured in place with tied on strings; said funnel pieces smaller portion being inserted into the bottom end of the reel type piece and the respective nylon cable being passed through the inside of the funnel pieces and the reel type pieces so that the boxing arm may move in an unpredictable fashion, wherein said cable is held in place by the metal rod on the reel type pieces; and wherein the metal triangle is located partially inside the reel type piece holding the metal rods and the metal springs; said rocking funnel-reel movement allowing for a superior-inferior and inferior-superior rotational or straight movement of the respective arm.

2. The boxing device of claim 1, wherein said padded arms and bag further comprising pressure sensors on the padded arms gloves and on specific areas of the bag to count the punches that the trainee receives or lands to give the simulation of a boxing match.

3. The boxing device of claim 1, said bag further comprising colored dots to improve punch accuracy.

4. The boxing device of claim 1, wherein the upper arm is longer than the lower arm to simulate a jab and a body punch respectively.

* * * * *